US011545319B2

(12) United States Patent
Knops

(10) Patent No.: US 11,545,319 B2
(45) Date of Patent: Jan. 3, 2023

(54) MECHANICAL COMPUTER KEYBOARD WITH ANALOG INPUT

(71) Applicant: Alltrons R&D B.V., Eindhoven (NL)

(72) Inventor: Kayle Silvia Pascal Knops, Eindhoven (NL)

(73) Assignee: ALLTRONS R&D B.V., Eindhoven (NL)

( * ) Notice: Subject to any disclaimer, the term of this patent is extended or adjusted under 35 U.S.C. 154(b) by 0 days.

(21) Appl. No.: 17/277,466

(22) PCT Filed: Sep. 20, 2019

(86) PCT No.: PCT/NL2019/050633
§ 371 (c)(1),
(2) Date: Mar. 18, 2021

(87) PCT Pub. No.: WO2020/060413
PCT Pub. Date: Mar. 26, 2020

(65) Prior Publication Data

US 2021/0272760 A1 Sep. 2, 2021

(30) Foreign Application Priority Data

Sep. 20, 2018 (NL) ..... 2021672

(51) Int. Cl.
*H01H 13/70* (2006.01)
*H01H 13/7073* (2006.01)
*H01H 13/83* (2006.01)

(52) U.S. Cl.
CPC ..... *H01H 13/7073* (2013.01); *H01H 13/83* (2013.01); *H01H 2235/01* (2013.01);
(Continued)

(58) Field of Classification Search
CPC ..... H01H 13/7073; H01H 13/83; H01H 2235/01; H01H 2239/006
(Continued)

(56) References Cited

U.S. PATENT DOCUMENTS

2013/0076542 A1* 3/2013 Tanaka ..... H03K 17/9647 200/5 A
2015/0061901 A1* 3/2015 Casparian ..... H01H 13/705 341/22
2018/0081450 A1 3/2018 Veh et al.

FOREIGN PATENT DOCUMENTS

DE 102011106786 A1 1/2013

OTHER PUBLICATIONS

International Search Report and Written Opinion dated Feb. 11, 2020 for PCT/NL2019/050633.

* cited by examiner

*Primary Examiner* — Edwin A. Leon
*Assistant Examiner* — Iman Malakooti
(74) *Attorney, Agent, or Firm* — Suiter Swantz pc llo

(57) ABSTRACT

A mechanical computer keyboard including a plurality of keys and an input/output (i/o) interface for output of registration of pressing one or more of the plurality of keys. Each key includes a keycap, a key switch including a stem, a key registration unit for registering a keystroke, and a spring for forcing the keycap in a neutral release position and providing a perceptible increase in pressing force. The keyboard further includes an analog-to-digital converter and the keys include a distance sensor unit for determining a travel distance of the pushing-down of the keycap by measuring a complex electrical impedance corresponding to the travel distance of the pushing-down the keycap, wherein the analog-to-digital converter is configured to convert the complex electrical impedance to a digital input signal including a
(Continued)

digitalized keystroke travel distance for outputting of the digital input signal by the i/o interface towards the computer.

18 Claims, 2 Drawing Sheets

(52) U.S. Cl.
CPC . *H01H 2239/006* (2013.01); *H01H 2239/022* (2013.01); *H01H 2239/024* (2013.01)

(58) Field of Classification Search
USPC ..... 200/5 A; 341/22, 25
See application file for complete search history.

MECHANICAL COMPUTER KEYBOARD WITH ANALOG INPUT

TECHNICAL FIELD

The present disclosure relates in general to the field of mechanical computer keyboards. More specific, the present disclosure relates to mechanical computer keyboards, binary-to-analog mechanical computer keyboard converting modules, as well as a method of upgrading a mechanical computer keyboard for registering analog input of one or more key switches of a keyboard.

BACKGROUND

Keyboards are one of the most important computer peripherals. Keyboards are available as stand-alone input device but also integrated into laptops or other (handheld) devices.

One of the essential parts of the keyboard is the key switch. In general, two core keyboard types can be recognized. The first type is a membrane keyboard in which the key switches are made from a membrane such as a sheet of rubber, or alternatively from other material that provides resistance, tactile feedback and registers and communicates the keypress to the computer or other connected device. The second type is a mechanical keyboard which has individual, key switches with metal springs. In the second type, the key switches can sometimes be replaced, either by desoldering or by use of key switch sockets.

The membrane keyboards are the most simplistic type of keyboards. Amongst other reasons, this can be attributed to the simple design in which all or most key switches use the same rubber sheet. Membrane keyboards are also easier to manufacture then mechanical keyboards due to their simplicity.

Although mechanical keyboards are more complex, have individual key switches, more components, and are often less thin than the membrane type keyboards, they are the preferred choice in high demanding applications. Mechanical keyboards provide better (tactile) feedback due to the longer travel of the keys, the feeling of the dump, sound upon pressing the keys, do not need to be bottomed out for registration of the actuation, etc. Hence, they are not only more satisfying than a membrane keyboard, but more accurate too.

The key switches of the keyboard are covered by so called keycaps. When pressing the keycap, the keyboard is able to detect this pressing motion and register actuation of that particular key. The registration is binary, which means that the keyboard is only able to determine if the key is pressed or not.

Hence, whereas a keyboard may have a relatively large number of input elements (keys), each key is only able to produce input data with a low binary resolution, i.e. either "on"/"1" or "off"/"0".

Other computer peripherals such as analog joysticks on the other hand have only a limited number of input elements, i.e. the stick and a few trigger buttons. Most keys are however able to produce input data at a high resolution.

Also, other computer input peripherals may have analog joystick like elements and functionality. An analog stick on a controller for example has greatly overtaken the d-pad in both prominence and use in video control games.

Analog sticks are particularly useful for accurate movement of objects displayed on the computer screen, e.g. to control movement of a playable character in a computer game with additional input data, such as when the movement has to be accurate, or when magnitude or speed is relevant as well.

Some computer applications are better suited for control through an analog input device such as the joystick and other through a digital input device such as the keyboard. Control of some computer applications such as computer games may even require both analog as well as digital input devices.

Since the keyboard is for most devices a mandatory computer peripheral this input device is often the main input device. The keyboard however fails to provide analog input.

Consequently, there is a need for an improved computer keyboard which is able to register analog input commands.

SUMMARY

The above mentioned and other objects are achieved, in a first aspect of the present disclosure, by a mechanical computer keyboard, for use as an input device of a computer, said keyboard comprising a plurality of keys and an input/output, i/o, interface for output of registration of pressing one or more of said plurality of keys, wherein each key comprises:

a keycap, arranged for operating said key by pushing-down said keycap;

a key switch, said key switch comprising:

a stem, arranged for connecting with said keycap;

a key registration unit, arranged for registration of a keystroke upon said operating of said key;

a spring, arranged for forcing said keycap in a neutral release position and providing a perceptible increase in pressing force upon pushing-down said keycap, characterized in that said keyboard further comprises: an analog-to-digital converter and said key further comprises a distance sensor unit, arranged to determine a travel distance of said pushing-down of said keycap by measuring a complex electrical impedance corresponding to said travel distance of said pushing-down said keycap, and wherein said analog-to-digital converter is arranged to convert said complex electrical impedance to a digital input signal comprising a digitalized keystroke travel distance for outputting of said digital input signal by said i/o interface towards said computer.

The mechanical keyboard according to the first aspect of the present disclosure further also comprises an analog-to-digital converter and said key further comprises a distance sensor unit, arranged to determine a travel distance or keystroke travel distance of said pushing-down of said keycap by measuring a complex electrical impedance corresponding to said travel distance the keystroke or in other words, of said pushing-down of said keycap. The analog-to-digital converter is arranged to convert said complex electrical impedance to a digital input signal comprising a digitalized keystroke travel distance for outputting of said digital input signal by said i/o interface towards said computer.

Computer keyboards are computer peripherals which are considered as one of the most important devices used for interfacing with the computer. The keyboard uses an arrangement of keys to act as mechanical levers or electronic switches. Each key of the keyboard consists of a key switch, which provides the actual registration of the keystroke, and a keycap which is a small, often plastic, cover that is placed over the key switch and provides an indication of the function of the key or an alphanumeric character to which the key corresponds.

Previously, the keycap and the key switch were integrated into a single homogene key. Nowadays however, they are almost always separate to facilitate the production of different keyboard layouts.

Keyboards may differ from each other in a lot of aspects. For example, in size and in type of interface. The size of the keyboard depends on the type of application. A laptop keyboard is often smaller, a smaller keystroke travel distance and often less keys. Gaming keyboards on the other hand have more keys, longer keystroke travel and more space between the keys.

The most widely used keyboard is most likely the membrane keyboard. This is mainly because membrane keyboards can be manufactured in an automated manner in huge quantities and thus for low prices. Mechanical keyboards often require manual labour which raises the price significantly. Mechanical keyboards differ from membrane keyboard in that they consist of individual key switches. These keyboards have a plurality of digital sensors, called key switches which register the keystroke on a particular key of the finger of the operator of the keyboard.

Most key switches are only able to register two values, i.e. a keystroke or no keystroke. With such a binary 1 or 0 way of registering keystrokes a lot of information is lost or simply not inputted into the keyboard. The speed of pressing the key, the force used upon pressing and the travel distance of the keystroke are not registered by such key switches.

There are many applications in which it is very beneficial to register such additional input data like the travel distance of the key, for example in computer games. Currently, such computer games therefor often are controlled through an analog input controller like a joystick.

The joystick however also has drawbacks that for example the amount of key switches is limited. Hence, although certain input can be controlled with a higher level of accuracy, i.e. resolution, it is difficult to register a large number of different types of input.

In gamepads or joypads both are combined. Most gamepads have both a set of buttons that register different types of input in a binary way, as well as one or more analog joysticks or d-pads which may be able to register directional input in an analog way with a high resolution.

The accurate and pleasant use of gamepads is one of the reasons that (video) game consoles are often chosen as the preferred computer platform to play computer games. Home computers that are controlled trough a conventional computer keyboard often do not meet the high expectations of the computer game player. It is therefore beneficial if the computer keyboard could be equipped with key switches that are able to register analog input data.

Most of the mechanical type key switches currently used have a very sophisticated design, long lifespan, low wear level, improved feedback, are highly stable and very robust. Simply replacing such a key switch with an analog input controller cannot guaranty that these advantages are maintained.

The present disclosure is based on the insight that the analog input should be provided without altering the current key switch design. This is achieved by adding to the key switch (instead of replacing) an analog-to-digital converter, ADC, and a distance sensor. The distance sensor should preferably cooperate with the key switch without any modification to the key switch itself.

This object is achieved by a sensor that is able to measure a complex electrical impedance. This complex electrical impedance can be converted to a digital signal which contains the analog (or a plurality of discrete steps) input data. The converting is performed by the ADC for further communication of the registered analog input data towards the computer or other connected device.

With complex electrical impedance is meant the level of resistance to alternating current, AC, circuit and possesses both magnitude and phase, unlike resistance which only has a magnitude component. Although impedance is a complex number, with the same units as resistance, for which the SI unit is ohm (Ω), the symbol of impedance is Z.

In addition to resistance as seen in direct current, DC, circuits, impedance in AC circuits includes the effect of the induction of voltages in conductors by the magnetic field, i.e. inductance, and the electrostatic storage of charge induced by voltages between conductors, i.e. capacitors. Accordingly, the present invention provides a key switch with an inductance and/or a capacitance sensor.

Proximity sensors are known and could be used in keyboards to transform a binary key switch into an analog sensor. Most proximity sensors however cannot be integrated into the keyboard without modifying the key switch or without replacing the key switch with an analog sensor element.

The mechanical key switch that is used in most of the mechanical keyboards comprise a spring. That spring is electrically conductive, or at least can be replaced very easily by such conductive variant. The present disclosure is based on the insight that such a conductive spring can be used as an element of a complex electrical impedance circuit. In particular, the spring may be used as an electrically and magnet conductive element which, upon compressing the spring influences the magnetic field, i.e. the inductance, in the sensor. By placing the sensor near the key switch, the compression of the spring will correlate or correspond to the variation in inductance.

The sensor may also be based on a variation in conductance. This variation may be created by the compression of the spring but also by other moving action such as the movement of the finger of the operator on the keycap upon pressing-down the key. Measuring the variation in conductance can thus be embodied in several manners. In a preferred embodiment, the sensor consists of two conductive elements such as a conductive surface. These two conductive elements may be provided as additional components in addition to the conventional elements that already exist in the keyboard. However, conventional, eclectically conductive elements that are already present in the keyboard may also be used as one or both of the conductive elements of the conductance sensor. For example, most keyboards have a metal plate on which the key switches are mounted. The metal plate can be used as one of the conductive elements, i.e. one of the electrodes of the conductance. In such an example, the (flexible) circuit board may have a conductive surface which acts as the first electrode of the conductance, and the metal plate as the second electrode thereof. Since the spring is located in between these two electrodes or conductive elements, the movement of the spring, or more precise, the compression of the spring, will influence the conductance. This variation can be measured, digitalized by the ADC and used as a variable that corresponds to the travel distance of the pressing-down of the key. As an alternative for the key, the finger of the operator of the keyboard can also be used as one of the electrodes. In such a case, the distance between the finger (as the second electrode) and the first electrode varies, by which the conductance also varies accordingly.

Since the keyboard will only interface with the device, i.e. computer, through digital communication, the analog signal will have to be digitized first by the ADC before the digital signal can be outputted to the device as controller data.

To facilitate the interface, the keyboard according to an aspect of the present disclosure is able to simulate a different computer input peripheral such as a game controller. This has the advantage that most operating systems already have built-in driver software for such controllers such that employment of the keyboard according to the present disclosure does not require additional software modifications.

In an embodiment, said keyboard comprises a printed circuit board for receiving each of said plurality of keys and comprising leads for electrically connecting said contact circuit of said plurality of keys with said i/o interface, and said distance sensor unit comprising a first electrically conductive element arranged to be disposed between said printed circuit board and said key switch, and a second electrically conductive element comprised of said spring of said key switch.

In another embodiment, the keyboard comprises a printed circuit board for receiving each of the plurality of keys and comprising leads for electrically connecting said key registration unit of the plurality of keys with the i/o interface, and wherein the distance sensor unit comprises a first electrically conductive element arranged to be disposed on the printed circuit board and a second electrically conductive element comprised of the spring of said key switch.

The distance sensor is comprised of two electrically conductive elements which are disposed at a certain distance from each other. The spring of the key switch, which is present in conventional keys of known mechanical keyboards, is used and operated as one of the electrically conductive elements. The other electrically conductive element is formed by a conductive element such as a coil which is preferably integrated on or in the printed circuit board. This coil, i.e. the first electrically conductive element, is thus an additional component on the printed circuit board which is already present in the keyboard. Alternatively, the first electrically conductive elements or coil may also be disposed on a separate, auxiliary printed circuit board, for example a flexible printed circuit board. Such auxiliary printed circuit board may then be arranged on top of, or below the printed circuit board of the keyboard. In comparison with the auxiliary printed circuit board, it is advantageous to integrate the first electrically conductive element or coil on, or in the printed circuit board since have only one board simplifies the production process and saves components.

The communication between keyboard and the device to which the keyboard is connected, e.g. the computer, takes place through a conventional interface such as a USB interface. The addition of the analog input which is made available by the distance sensor and the ADC is preferably also outputted to the computer through the same USB interface. This however may also be a different USB, second interface, or through yet another type of interface. The skilled person will appreciate which interfaces exist and are applicable for interfacing with the keyboard.

The distance sensor is preferably operable by use of the spring that is present in the key switch. The spring is compressed in accordance with the travel distance of the keystroke. Since the compression of the spring influences the electrical impedance of the sensor, the measurement of the conductance and/or the impedance is a perfect value to determine the travel distance of the pressing of the key.

In an embodiment, said first electrically conductive element of said distance sensor unit comprises a coil arranged for generating a variance in inductance in correspondence with compression of said spring of said key switch.

Although both conductance and impedance can be measured and correlated to the travel distance of the key, the measurement of the impedance is preferred. This can be done by using an electrical circuit in which a coil or inductance is included. Having an electrical circuit for measuring complex electrical impedance by using a coil is beneficial since it can be manufactured in a very thin manner on a printed circuit board and is very accurate. Another advantage to the use of an impedance is that only one single layer of conducting material is required. This makes it possible to use a single layer circuit board which in the simplest embodiment is provided with a (printed) coil on only one side of the circuit board and the other side is only used for the electrical connections (leads). Increasing the windings of the coil will increase the accuracy and thus the accuracy can be increased to the desired level simply by adding windings on the printed circuit board on which the sensor, in this case the coil, and the ADC are located.

Alternatively, the coil (and/or the ADC and/or optionally any other electrical components for registration, processing and outputting the analog input data) may also be a conventional separate component. Such a conventional component has larger diameters than the printed version. Hence, the positioning is limited and is preferably positioned on the printed circuit board in a manner that it will not influence the original function of the key switch. That means, that the coil may be located in the proximity of the key switch but on the printed circuit board of the keyboard itself. Either on the top side, in the direction of the key switch, or on the bottom side, away from the key switch. Alternatively, the coil may also be placed on the additional (flexible) printed circuit board on which the ADC is placed as well.

In an example, said key registration unit of said key switch further comprises:

a contact circuit, arranged for connecting and interrupting an electrical circuit of for registration of said keystroke; and wherein said key switch further comprises:

a slider, arranged for displacement of an element of said contact circuit for connecting and interrupting said electrical circuit in response to said keystroke.

In an example, said first electrically conductive element of said distance sensor unit comprises an electrically conductive surface forming a first electrical conductor of a capacitor and a second electrically conductive surface in said keyboard forming a second electrical conductor of said capacitor, wherein said spring of said key switch is disposed in between said first and second electrical conductor for generating a variance in capacitance correspondence with compression of said spring of said key switch.

In another example, the distance sensor may be implemented as a capacitive sensor in which a variation in capacitance corresponds to the level or depth of the pressing of the key.

In an embodiment, said first electrically conductive element of said distance sensor unit and said analog-to-digital converter are disposed on a flexible printed circuit board arranged to be disposed between said printed circuit board and at least one of said plurality of keys of said keyboard.

The capacitive distance sensor may have an undesired side-effect. This side-effect is the electrical effect of the human finger on top of the keycap above the key switch. Each finger differs in size and electrical properties and each keypress may be re-located to a different spot on top of the keycap. As such it is nearly impossible to filter this additional capacity from the data measured by the capacitive distance sensor. To overcome this disadvantage, it is suggested, in an example, to provide a layer of conductive material on the bottom side of the keycap and to connect it to the sensor chip or to ground.

In an embodiment, the distance sensor unit is arranged to drive metal contacts of the key registration unit to obtain a high voltage potential over the contacts for measuring a first capacitance and to obtain a low voltage potential over the contacts for measuring a second capacitance, and wherein said analog-to-digital converter is arranged for obtaining the complex electrical impedance by subtracting said measured first and second capacitances.

When measuring the complex electrical impedance through the embodiment of the capacitive distance sensor, the capacitance between the printed circuit board, the spring and the metal contacts or conductive elements, such measurement may be distorted by noise. By performing two consecutive measurements on one but preferably on all keys, the noise can be suppressed or even cancelled-out from the signal. In the first measurement, the metal contacts of the key registration unit have a high signal voltage on them, and in the second measurement, they have a low signal voltage. These voltages may for example be approximately 5 Volt or 3.3 Volt or any other voltage obtained or derived from Vdd or the power supply in general, e.g. a CMOS or TTL high and low signal, wherein the high signal for example has a voltage in the range of approximately 2.0-5 Volt and the low signal in the range of approximately 0-0.8 Volt. Once both voltages are measured, they may be subtracted from each other such that the metal contacts in the switch which affects the total impedance is reduced or even cancelled-out. As such, the accuracy of the measurement is increased.

In a more generalized example, noise may be suppressed or reduced by obtaining two measurements, wherein the first measurement represents a reference value and the second measurement represents the actual value. Subtracting the reference value from the actual value will result in a relative measurement, whereas obtaining only one single value will result in an absolute measurement. The relative measurement is advantageous since the level of noise will be lower.

In a further example, the reference value is obtained by a single sample or through multiple samples. The sample or samples may be taken at regular intervals, or preferably, at a certain moment in time when the keyboard is not in use, i.e. directly after detecting a power-on signal.

Not only may such additional measurement increase accuracy, it also enables other possibilities such as identification of which finger the user of the keyboard is used to press a specific key switch. This could be used to give instructions to the user to learn a better way of typing on a keyboard. It also enables identification of the person who is typing on a keyboard. Use of the keyboard or the computer may be blocked when it is determined that an unauthorized person is using the keyboard. Finally, it also enables to measure if the impedance from the finger decreases or increases over a certain period of time (e.g. several hours), to see if the user gets dehydrated. This could be used to give health advice. For instance, the user could be instructed to drink some water.

In an embodiment, said flexible printed circuit board comprises a plurality of first electrically conductive elements for a plurality of keys of said keyboard.

The flexible printed circuit board could be provided for a single key but is preferably configured to measure several keys of the keyboard. In yet another example, the flexible keyboard is also able to measure all keys of the keyboard and in the most preferred example, a set of related keys are upgraded to measure the distance. These related set of keys could for example be a special key with a surroundings key in layout of the keyboard, or for example the arrow keys.

In an embodiment, said flexible printed circuit board comprises a flexible insulating substrate having a first and second surface side comprising a first and second segment of said coil, respectively, and wherein said first and second segments consists of a flat spiral shaped coil, interconnected by a through via through said flexible printed circuit board.

In an embodiment, said flexible printed circuit board is a multi-layer flexible printed circuit board, comprising a flexible insulating multi-layer substrate, each layer comprising segment of said coil, and wherein each segment consists of a flat spiral shaped coil, interconnected by a through via through said layer of said flexible printed circuit board.

When measuring inductance, the sensor is provided with a coil. The coil can be manufactured as a printed coil, either on the PCB of the keyboard or on an auxiliary flexible circuit board. Printing the coil on the PCB of the keyboard itself is beneficial since this will make the production process easier. The components required for the distance sensor, e.g. the coil, can be mounted on the PCB in a single production step together with the other components of the keyboard. Using a flexible PCB is also beneficial since this will require no modification to the production process of the keyboard. The flexible keyboard can be manufactured separately and integrated at a later stage in the production process.

The printed coil may comprise a large number of windings that are distributed across the layers of the board, i.e. on both sides of a single layer board, or on multiple layers of a multi-layer board. In the latter example, the intermediate substrate may be provided with windings as well.

The coil may be formed as a spiral, which means that it could be curved and emanates from a point, moving farther away as it revolves around the point. It however may also have other shapes than a curved or partly curved shape. For example, rectangular, triangular, or racetrack shaped. The skilled person will appreciate many other shapes will also function.

In an embodiment, said key switch comprises any of the group consisting of a Cherry MX® key switch, Cherry ML® key switch, Adomax Flaretech key switch, or an ALPS style key switch. The key switch can be a linear, tactile and not-clicky or tactile and clicky key switch.

Preferably, the key switches according to the present disclosure are known key switches from manufacturers which have proven to be very reliable and robust. Such key switches do not require modification but could, by way of example, be modified to better facilitate the registration of the depth of pressing the keys, e.g. by adding a conductive layer to the keycap, or by grounding it.

In an embodiment, the contact circuit is an electronic contact circuit and the slider is arranged for displacement of an element of the electronic contact circuit to connect and interrupt the electronic circuit in response to said pushing-down and releasing of said keycap, or wherein the contact circuit comprises a light emitting element, such as a light emitting diode, more in particular, an infrared light emitting diode, as well as an optical detecting element, and wherein said slider comprises an element for blocking or allowing light between said light emitting diode and said optical element, for connecting and interrupting said electrical circuit in response to said pushing-down and releasing of said keycap.

In an embodiment, the key registration unit comprises a light emitting element, such as a light emitting diode, more in particular, an infrared light emitting diode, as well as an optical detecting element, and a lens unit, in particular a prism lens unit, and wherein said slider is arranged to displace said lens unit for registration of said keystroke by said optical detecting element in correspondence with said keystroke.

The present disclosure is arranged for analog keystroke input registration in combination with a plurality of different types of keyboards. For example, keyboards that use mechanical key switches that consists of mechanical sliders which displace an element of the contact circuit to register the keystroke in a binary manner, or also key switches that make use of a light emitted by a LED or for registration of the keystroke, e.g. either in binary or in a continuous manner or in a discrete manner with several distinct steps. The present disclosure, in all examples, may replace the original binary registration of the keystroke, or as a addition to the binary registration. In case of a key switch that is able to register continue or several discrete steps of the keystroke, the present disclosure, in all examples, may also work as an addition to this function. Or the other way around, in which the components already present may work to further improve the registration or increase the functionality of the keyboard.

In an embodiment, the analog-to-digital converters of the keys of the keyboard are arranged for simultaneous parallel conversion of the complex electrical impendences to the digitalized keystroke travel distances of a selection of key switches.

In a further embodiment, the selection is defined by a list of operated key switches, and wherein the operated key switches are determined by key registration units registering a keystroke of the key upon operation of the key.

Limiting the number of simultaneous parallel conversion of the complex electrical impendences to the digitalized keystroke travel distances is advantageous as thereby the number analog-to-digital converters may be reduced. In a preferred example, the number of converters may correspond to the maximum number of simultaneously operated keys, e.g. 10. Alternatively, is may also be preferred to have 8, 6 or 5 converters to obtain a balance between addition of components and increase in the number of keys arranged for simulations digitalization of the keystroke travel distances.

In a second aspect of the present disclosure a binary-to-analog mechanical computer keyboard converting module is presented, said module comprising a flexible printed circuit board in accordance with any of the previous descriptions for use in a mechanical computer keyboard according to the previous description.

In a third aspect of the present disclosure a method is presented of upgrading a mechanical computer keyboard for registering analog input of one or more key switches of said keyboard, said method comprising the steps of:

providing a mechanical computer keyboard;

providing a binary-to-analog mechanical computer keyboard converting module in accordance with the previous description;

positioning said keyboard converting module between said one or more key switches and said printed circuit board of said keyboard;

connecting said keyboard converting module with i/o interface of said mechanical computer keyboard.

In the method described above, the binary-to-analog chip and sensor component could also be placed on the PCB that is already present in the keyboard. In that case, the positioning of the flexible circuit board between the key switch and the PCB is superfluous.

In a fourth aspect of the present disclosure a switch is presented, said switch comprising: a switch cap, arranged for operating said switch by displacement of said switch cap over a switch travel distance; a resilience element for forcing said switch cap in a neutral release position and providing a perceptible increase in operating force upon operating said switch, wherein the switch further comprises: an analog-to-digital converter and a distance sensor unit, arranged to determine a switch travel distance of said operating of said switch by measuring a complex electrical impedance corresponding to the switch travel distance of said displacement of the switch cap, and wherein the analog-to-digital converter is arranged to convert the complex electrical impedance to a digital input signal for outputting of the digital input signal over an i/o interface.

These and other objects, advantages, and features of the invention will be readily understood and appreciated by reference to the detailed description of the current embodiment and the drawings.

DETAILED DESCRIPTION

Figure 1:
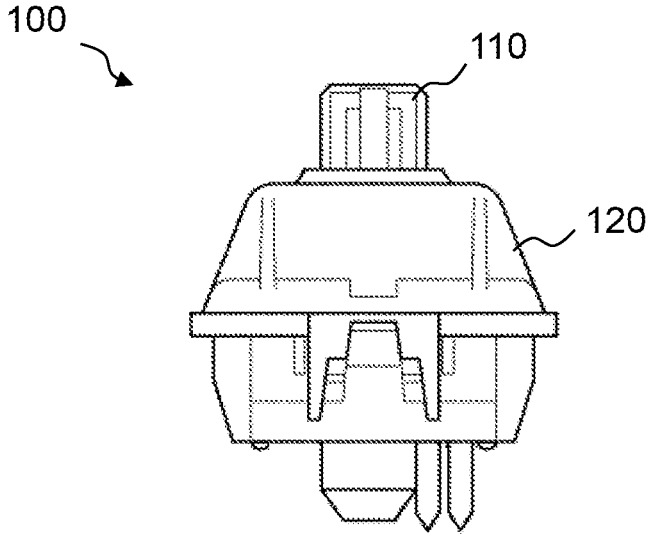
FIG. 1 shows, from a side view, an example of a key switch according to the prior art.

FIG. 1 shows a key switch 100. The key switch is a mechanical key switch for a mechanical keyboard which consists of several individual key switches such as the key switch illustrated in FIG. 1. These key switches can be sold separately and sometimes, the computer keyboard is arranged for easy replacement of these keys through use of a key switch socket that is permanently fixed on the Printed Circuit Board, PCB, but which makes it possible to have the key switches removed and replaced without desoldering them from the PCB.

Figure 2:
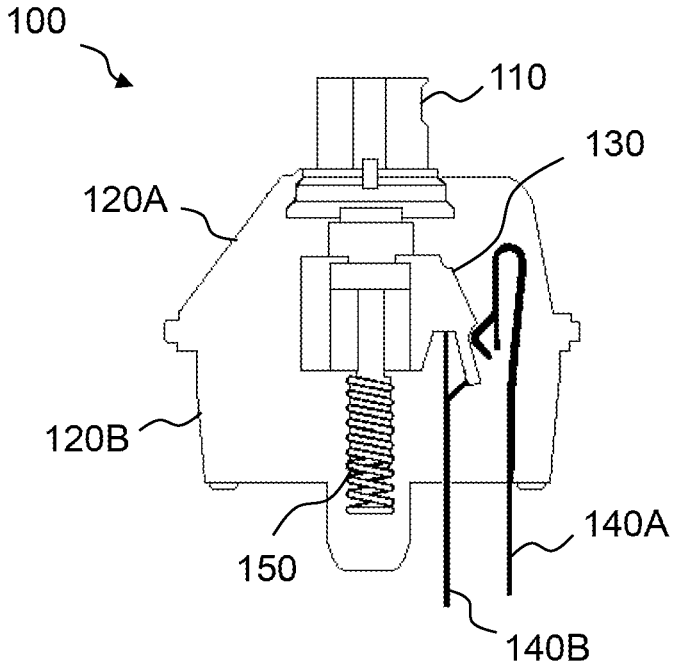
FIG. 2 shows, the internal components of the key switch according to the prior art.

The key switch shown in FIGS. 1 and 2, is a key switch known in the art and consists of several components such as a housing 120 and a stem 110. The stem is for receiving the key cap (not shown) and the housing houses the rest of the components of the key switch 100.

These other components are shown in FIG. 2. The housing 120 of the key switch 100 keeps all the components together. However, the housing 120 is not a necessary element of the key switch and could consist of multiple separable parts. The components could also be configured in a different manner in which they are mutually connected without housing.

The slider 130 is what eventually determines how tactile, clicky or linear the switch 100 is. In the example shown in the figures, the slider 130 and stem 110 are described as separate components. These could indeed be separate components, but can also be integrated into a single component.

If the slider 130 is tactile, as shown in the figure, the pressing-down of the key will provide some tactile feedback. The slider could however also be shaped differently (e.g. linear) to provide less, non or more tactile feedback, or to make the pushing-down clicky or not-clicky. The point of actual registration of the keystroke can be defined by the slider as well. For example, the slider may have a first segment in which tactile feedback is giving upon pressing the key, and a second segment, which in time follows the first segment, that register the actual keystroke by moving the contact circuit of the key to either disconnect or connect an electrical circuit. These contacts 140*a*, 140*b* of the electrical contact circuit 140 can thus either be a standard or normally open or standard closed contact circuit. The spring 150 defines the level of force that has to be applied to the key in order to register the keystroke. The shape of the slider 130 however may also have some influence on the amount of force that has to be applied with the keystroke since for example tactile or clicky shaped sliders provide resistance as well.

The key switch shown in FIGS. 1 and 2 are merely shown by way of example. These key switches consist of a few standard components such as the stem 110, contact circuit, slider, and spring. Since the present disclosure will provide a means for registering analog input with such a conventional key switch, the skilled person will appreciate that other, mechanical, key switches will work as well. For example, the way in which the keystroke is registered, e.g. by detecting a short or open circuit of the contact circuit 140, can also be performed in an electronic manner with an additional sensor. Examples thereof are also optical or photo electronic key switches. Key switches could be provided with an (infrared) light emitting element, e.g. an IR-LED. The light element emits a light beam and an optical element detects if the beam is still received or blocked. The stem of the key switch comprises an element that blocks or unblocks the light beam when the key is pressed-down. This way the keystroke can be registered without electronic circuit known from conventional mechanical keyboard. Accordingly, the present disclosure does not exclude such alternative mechanical key switches but can be used for such types as well. The slider of the present disclosure could therefor also be a slider for blocking or unblocking/allowing a light beam to be transmitted between a light emitting element such as a LED and an optical sensor. In this case, the light emitting element and the optical sensor form the contact circuit and the slider is arranged to block/unblock the light beam.

Figure 3:
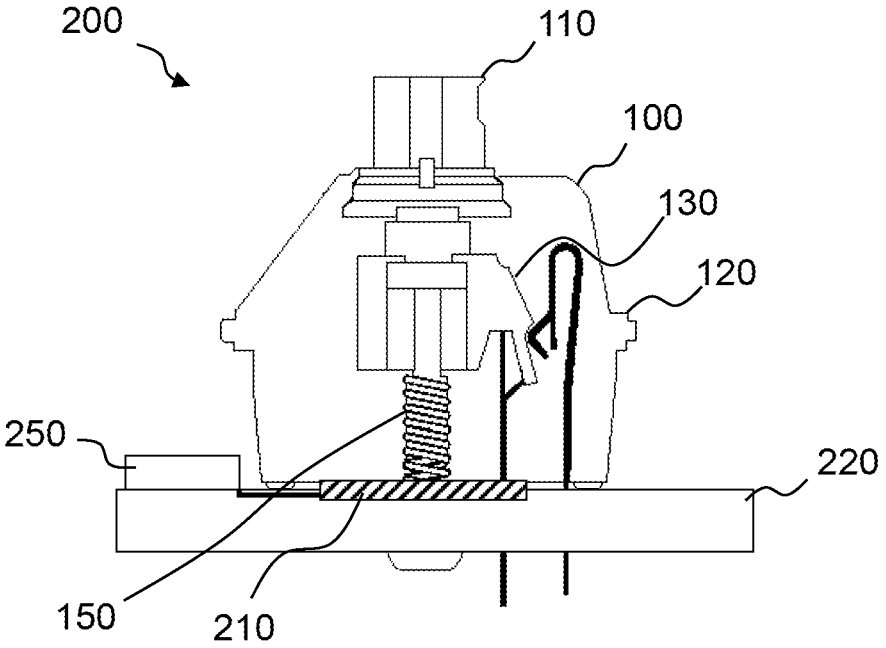
FIG. 3 shows, the internal components of a key switch with a distance sensor in accordance with an aspect of the invention.

In FIG. 3 the key switch 100 of FIGS. 1 and 2 is shown again but with additional components to provide for registration of an analog input of the key switch. In view of the present disclosure, analog input can be defined as the travel distance, travel time, travel speed, travel acceleration or jerk of the keystroke. This means that besides distance other physical quantities could be registered as well.

The present disclosure provides means for registering these physical quantities such as distance and/or time. This registration is outputted to the device to which the keyboard is connected, for example a personal computer. Corresponding data may also be inputted into the keyboard and for example to a microprocessor inside the keyboard, e.g. for configuration of the sensor, the Analog-To-Digital converter, ADC 250, or the microprocessor itself and for example the way in which the keyboard simulates a known video game controller or other input peripheral.

The standard use of the analog input data is to add an extra component to the input data. Whereas conventional keyboard data is binary, i.e. the key is pressed or not, the analog input data provides input at a high(er) resolution. The resolution corresponds to the level of accuracy of the sensor and can be increased by increasing the windings of the coil, and/or the shape of the coil (spiral, circular, rectangular, triangular, racetrack, etc.) upon inductance sensing or by removing interference signals upon capacitive sensing. In an example, the sensor is arranged for at least distinction of input at a resolution of approximately at least 5 discrete positions, more preferably at least 25 discrete positions, even more preferably at least 50 discrete positions, at least 100 discrete positions, more preferably approximately at least 500 discrete positions, even more preferably approximately at least 1000 discrete positions, or most preferably approximately at least 2000 discrete positions. In a preferred embodiment, the coil may have approximately at least 15 windings.

Alternatively, or in another configuration modus, the keyboard according to an aspect of the invention may also be suitable for having a configurable actuation registration moment. This means, that conventional key switches have predefined actuation moments, which are defined by the slider and when the slider displaces the element of the contact circuit such that the circuit switches between short and open circuit. The present disclosure however may also bypass the slider and the contact circuit and use the distance sensor to determine if the key is pressed or not. Hence, in such a case, make swapping between key switches with different actuation moments superfluous. This is especially useful for persons who use the keyboard for different applications such as typewriting and playing video games. When typewriting, tactile feedback may have a higher priority that actuation speed. And thus, the moment of actuation only takes place when a certain threshold travel distance of the keystroke is exceeded, thereby preventing accidental keystroke registrations. When playing a video game, response time may be crucial. Hence, such a late keystroke registration may be undesirable and it may be preferred to have the key register the keystroke in the shortest time possible. Currently, such switching between these configurations requires replacement of the key switches. In some cases, these key switches may be placed on a key switch socket such that replacement is made very easy. In most cases however, these key switches are soldered to the PCB which makes replacement difficult and cumbersome.

Such quick switching between different actuation registration configurations can be achieved by using the distance sensor instead of the stem, slider and contact circuit to register the keystroke, even in a binary input registration mode.

The keyboard or the computer can be configured that for example binary input data is received from the keyboard but in which the actuation position of the key is different. On the other hand, the keyboard may also output digitalized analog input data. The computer can then decide to act upon receiving the first discrete step in the input data or upon a further, later discrete step, for example when the key is pressed already for 25% of the total allowable travel distance.

To increase the accuracy of the registration of the input data in an analog input modus, the key switch or PCB is preferably modified to disconnect the conventional binary input registration circuit. This could be achieved by (temporary or permanently) disconnecting the contact circuit. As an alternative to such a hardware modification, this can also be achieved through a software modification in the microprocessor on the PCB of the keyboard. The keyboard works with a matrix for processing of each individual key by the microprocessor. In an example, the keyboard matrix could be provided with additional rows and/or columns for processing of the analog input data. This has the advantage that both the conventional binary input data as well as the (analog) input data from the distance sensors can be processed in parallel. This allows the microprocessor to use both input simultaneously, or to temporarily or permanently switch between analog and binary registration of the keystrokes of one, a group of, or all keys of the keyboard.

Disabling the contact circuit can also be achieved by removing one of the slider elements 140*a*, 140*b*, or by interrupting one or more of the contacts of the key switch 100 that connect with the PCB. In the latter case, this could be achieved with a flexible printed circuit as well. The flexible printed circuit may have through holes to receive positioning or alignment pins for correct positioning of the key switch on the PCB, and interrupt other electrical connections between the contact circuit 140 in the key switch and the PCB 220 of the keyboard.

The key switch 100 according to a first aspect of the present disclosure as shown in FIG. 3 is provided with an additional sensor element 210. This sensor element is a coil, and in particular a printed coil 210 on a flexible circuit board. This coil is preferably placed below the key switch 100 and above or on top of the PCB 220 of the keyboard, on which PCB the key switch may be disposed, soldered or fixed in any other known manner.

The coil contains a certain number of windings and is connected to an ADC 250 that is arranged to convert an inductance in a digital signal as for further communication of this input data towards the computer or other device to which the keyboard is connected.

The inductance of the coil 210 changes when a conductive object or element comes it the proximity of the coil 210. Conventional key switches may already be equipped with such a conductive element, i.e. the spring. The spring is most likely made from a conductive material such as iron or any other ferromagnetic material. In case the spring is made from a non-conductive material, the spring may also be replaced by conductive one.

Since coil 210 is unshielded from the spring 150, the displacement of the spring influences the magnetic field of the coil and hence the inductance or energy stored in the magnetic field. Since level in which these two physical quantities change, i.e. the displacement of the spring 150 and the inductance of the coil 210, correlate to each other, the inductance is highly accurate value to determine the displacement of the spring, and hence, travel distance upon the keystroke.

Figure 4:
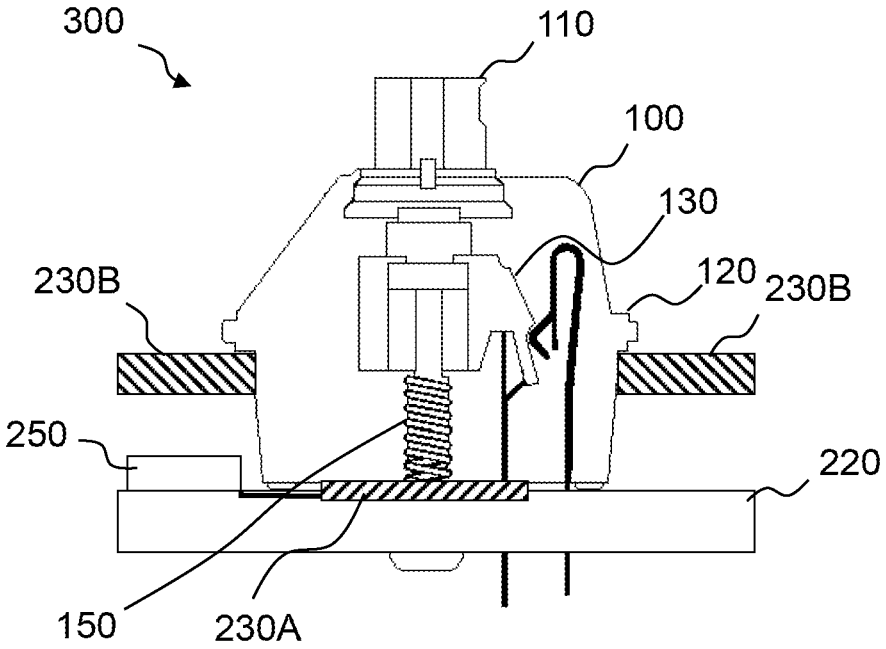
FIG. 4 shows, the internal components of a key switch with a distance sensor in accordance with another aspect of the invention.

In FIG. 4 an alternative version of the sensor is shown. The key switch 100 in FIG. 4 is the same as in the previous FIG. 1, FIG. 2 and FIG. 3. However, as already indicated above with reference to the first example of the present disclosure, the key switch 100 used for the sensor according to the second example of the present disclosure may also consist of other components such as an electronic sensor version of the slider/contact circuit arrangement.

The keystroke of the pressing-down of the key switch 100 as shown in FIG. 4 is registered through a change in capacitance of the capacitive distance sensor 230A. The capacitive distance sensor comprises a capacitor that is connected to an ADC for further communication towards the computer. A capacitor is a passive two-terminal electrical component that is able to store potential energy in an electric field between these two terminals. As such, the capacitor consists thus of two conductive terminals that have an isolating material in between to prevent depletion of the capacitor. These two terminals can differ and may be already present in the keyboard itself, e.g. by providing an electrical connection towards at least two different electrically conductive materials in the keyboard that are located close to each other but are not in direct, electrical, contact. Alternatively, and preferably, this is a combination of elements already present and elements added. This example is shown in FIG. 4, the PCB 220 or an additional (flexible or non-flexible) circuit board is provided with a conductive element such as a copper plate. This conductive element is the first terminal 230*a* of the capacitor and provided with a voltage potential. The second terminal 230*b* is provided by the metal plate to which the key switches 100 are mounted. This plate may be connected to ground. The plate may also be connected to the ADC 250 for noise or background reduction. By electronically connecting the plate to a shielding input of the ADC 250 the ADC can subtract the input signal obtained from the plate 230B from the input signal obtained from the capacitive sensor 230A such that a more accurate measurement can be achieved.

Since these two terminals 230*a*, 230*b* are positioned at a certain distance from each other, they will function as a capacitance. The capacitance will however be influenced by any conductive element that is in or near the electrical field of the voltage potential between the two terminals. This could be the spring but also a conductive surface added to the key cap for example. When the spring 150 is compressed, it will influence this field in a corresponding manner. And thus, the level of compression of the spring, which represents the travel distance of the key upon the keystroke, may be determined by measuring the fluctuation in capacitance between the two terminals 14*a*, 14*b* of the distance sensor 140.

Other variations to the disclosed examples can be understood and effected by those skilled in the art in practicing the claimed disclosure, from a study of the drawings, the disclosure and the appended claims. In the claims, the word "comprising" does not exclude other elements or steps and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored/distributed on a suitable medium, such as optical storage medium or a solid-state medium supplied together with or as part of other hardware, but may also be distributed in other forms, such as via the internet or other wired or wireless telecommunication systems. Any reference signs in the claims should not construed as limiting scope thereof. Similar reference signs denote similar or equivalent functionality.

The present disclosure is not limited to the examples as disclosed above, and can be modified and enhanced by those skilled in the art beyond the scope of the present disclosure as disclosed in the appended claims without having to apply inventive skills and for use in any data communication, data exchange and data processing environment, for example for use of the neuroprosthetic system for substituting auditory perception.

The invention claimed is:

1. A mechanical computer keyboard, for use as an input device of a computer, comprising:

a plurality of keys;

an input/output (i/o) interface for output of registration of pressing one or more of the plurality of keys; and an analog-to-digital converter;

wherein each key comprises:

a keycap for operating the key by pushing-down the keycap;

a key switch comprising:

a stem for connecting with the keycap;

a key registration unit for registration of a keystroke upon the operating of the key; and a spring for forcing the keycap in a neutral release position and providing a perceptible increase in pressing force upon pushing-down the keycap; and a distance sensor unit for determining a travel distance of the pushing-down of the keycap by measuring a complex electrical impedance corresponding to the travel distance of the pushing-down the keycap; and wherein the analog-to-digital converter is configured to convert the complex electrical impedance to a digital input signal comprising a digitalized keystroke travel distance for outputting of said the input signal by the i/o interface towards the computer.

2. The mechanical computer keyboard according to claim 1, wherein:

the key registration unit of the key switch further comprises a contact circuit for connecting and interrupting an electrical circuit for registration of the keystroke; and the key switch further comprises a slider for displacement of an element of the contact circuit for connecting and interrupting the electrical circuit in response to the keystroke.

3. The mechanical computer keyboard according to claim 1, further comprising a printed circuit board for receiving each of the plurality of keys and comprising leads for electrically connecting the key registration unit of the plurality of keys with the i/o interface, and wherein the distance sensor unit comprises a first electrically conductive element disposed between the printed circuit board and the key switch or on the printed circuit board, and a second electrically conductive element comprised of the spring of the key switch.

4. The mechanical computer keyboard according to claim 3, wherein the first electrically conductive element is integrated in the printed circuit board.

5. The mechanical computer keyboard according to claim 3, wherein the first electrically conductive element of the distance sensor unit comprises a coil for generating a variance in inductance in correspondence with compression of the spring of the key switch.

6. The mechanical computer keyboard according to claim 3, wherein the first electrically conductive element of the distance sensor unit comprises an electrically conductive surface forming a first electrical conductor of a capacitor and a second electrically conductive surface in the keyboard forming a second electrical conductor of the capacitor, wherein the spring of the key switch is disposed in between the first and the second electrical conductor for generating a variance in capacitance correspondence with compression of the spring of the key switch.

7. The mechanical computer keyboard according to claim 6, further comprising a metal plate for supporting the key switches, wherein the analog-to-digital converter comprises a shielding input terminal connected to the metal plate for receiving a background interference signal, and wherein the analog-to-digital converter increases the accuracy of the determined capacitance between the first and the second electrical conductor by subtraction by the shielding input.

8. The mechanical computer keyboard according to claim 6, wherein the distance sensor unit drives metal contacts of the key registration unit to obtain a high voltage potential over the contacts of the key registration unit for measuring a first capacitance and to obtain a low voltage potential over the contacts for measuring a second capacitance, and wherein the analog-to-digital converter is configured to obtain the complex electrical impedance by subtracting the measured first and second capacitances.

9. The mechanical computer keyboard according to claim 5, wherein the first electrically conductive element of the distance sensor unit and the analog-to-digital converter are disposed on a flexible printed circuit board disposed between the printed circuit board and at least one of the plurality of keys.

10. The mechanical computer keyboard according to claim 9, wherein the flexible printed circuit board comprises a plurality of first electrically conductive elements for the plurality of keys.

11. The mechanical computer keyboard according to claim 9, wherein the flexible printed circuit board comprises a flexible insulating substrate having a first and second surface side comprising a first and second segment of the coil, respectively, and wherein the first and second segments comprise a flat spiral shaped coil, interconnected by a through via through the flexible printed circuit board.

12. The mechanical computer keyboard according to claim 9, wherein the flexible printed circuit board is a multi-layer flexible printed circuit board, comprising a flexible insulating multi-layer substrate, each layer comprising a segment of the coil, and wherein each segment comprises a flat spiral shaped coil, interconnected by a through via through the layer of the flexible printed circuit board.

13. The mechanical computer keyboard according to claim 1, wherein the key switch is a linear, tactile and not-clicky or tactile and clicky key switch.

14. The mechanical computer keyboard according to claim 2, wherein the contact circuit is an electronic contact circuit and the slider is configured to displace an element of the electronic contact circuit to connect and interrupt the electronic circuit in response to the pushing-down and releasing of the keycap, or wherein the contact circuit comprises a light emitting element and an optical detecting element, and wherein the slider comprises an element for blocking or allowing light between the light emitting element and the optical element, for connecting and interrupting the electrical circuit in response to the pushing-down and releasing of the keycap.

15. The mechanical computer keyboard according to claim 1, wherein the key registration unit comprises a light emitting element, an optical detecting element, and a lens unit, and wherein the slider displaces the lens unit for registration of the keystroke by the optical detecting element in correspondence with the keystroke.

16. The mechanical computer keyboard according to claim 1, wherein the analog-to-digital converters of the keys are configured for simultaneous parallel conversion of the complex electrical impendences to the digitalized keystroke travel distances of a selection of the key switches.

17. The mechanical computer keyboard according to claim 16, wherein the selection is defined by a list of operated key switches, and wherein the operated key switches are determined by key registration units registering a keystroke of the key upon operation of the key.

18. A printed circuit board for a mechanical computer keyboard according to claim 1, the mechanical computer keyboard comprising a printed circuit board for receiving each of a plurality of keys and comprising leads for electrically connecting a key registration unit of the plurality of keys with the i/o interface, and the distance sensor unit comprises a first electrically conductive element disposed on the printed circuit board and a second electrically conductive element comprised of the spring of the key switch.

* * * * *